United States Patent [19]

Terasaki et al.

[11] Patent Number: 5,040,596

[45] Date of Patent: Aug. 20, 1991

[54] HEAT EXCHANGER CORE

[75] Inventors: Kazuo Terasaki, Machida; Hiroshi Takemura, Chofu, both of Japan

[73] Assignee: Mitsubishi Aluminum Kabushiki Kaisha, Tokyo, Japan

[21] Appl. No.: 337,042

[22] Filed: Apr. 12, 1989

[30] Foreign Application Priority Data

Apr. 13, 1988 [JP] Japan ..... 63-49798[U]
Apr. 18, 1988 [JP] Japan ..... 63-51772[U]
Apr. 25, 1988 [JP] Japan ..... 63-55776[U]

[51] Int. Cl.[5] ..... B28F 3/00

[52] U.S. Cl. ..... 165/166; 165/183; 165/185

[58] Field of Search ..... 165/166, 179, 181, 183, 165/185

[56] References Cited

U.S. PATENT DOCUMENTS 2,678,808 5/1954 Gier ..... 165/185
2,965,819 12/1960 Rosenbaum ..... 165/185 X
3,163,207 12/1964 Schultz ..... 165/185 X
3,455,376 7/1969 Beurtheret ..... 165/185 X

FOREIGN PATENT DOCUMENTS 572271 11/1958 Belgium .
1160975 1/1964 Fed. Rep. of Germany .
1300121 6/1962 France .
635691 4/1950 United Kingdom ..... 165/166

*Primary Examiner*—Robert G. Nilson

[57] ABSTRACT

Disclosed is a heat exchanger core in which a fluid is caused to flow through a pipe body rectangular in cross section so that the heat exchange is effected between the flowing fluid and a heat medium in contact with the outer walls of the pipe body. Within the pipe body, a plurality of projections and/or grooves for flowing the fluid at an inclined angle with respect to the direction of the flow of the fluid (the axis of the heat exchanger core) and the streams flow through the inclined passages, respectively, and then are reversed in direction. Such a flow pattern is repeated so that the efficiency of heat transfer by conduction can be improved without the noticeable increase in pressure loss.

18 Claims, 9 Drawing Sheets

HEAT EXCHANGER CORE

BACKGROUND OF THE INVENTION

1. Field of the Invention

The present invention relates to a heat exchanger core set in a heat exchanger of the type in which the heat exchange is carried out between a fluid flowing through a pipe and a heat medium outside of the pipe and more particularly a heat exchanger core best adapted for use in the evaporators of the air conditioning devices and refrigeration devices, the chemical apparatus the electronic equipment and the like.

2. Description of the Prior Art

The heat exchanger core of the type described above is assembled with a header for flowing a fluid through the core so as to construct a heat exchanger and it is known a core called a heat transfer pipe in which the heat exchange is effected between a fluid flowing through a pipe and another fluid flowing outside of the pipe.

FIGS. 1 and 2 illustrate conventional heat exchanger cores, respectively, in which a plurality of fins 4A and 4B are joined to the upper wall 2 and the lower wall 3 in opposing relationship with each other of a pipe body 1 having a flat rectangular cross sectional configuration are spaced apart from each other by a suitable same distance. In the case of the heat exchanger core illustrated in FIG. 1, the fins A and B are extended in the direction perpendicular to the direction in which a fluid flows through the pipe body 1 while in the heat exchanger core illustrated in FIG. 2 the fins 4A and 4B are extended in the direction in which a fluid flows through the pipe body 1. The fin 4A extended from the upper wall 2 and the opposing fin 4B extended from the lower wall 3 are in vertically coplanar relationship with each other and in the vertical direction, a predetermined space 5 is defined between the each fin pair 4A and 4B extended from the upper and lower walls 3 and 4, respectively.

In the cases of the conventional heat exchanger cores of the types illustrated in FIGS. 1 and 2, respectively, the heat transfer area of the inner surfaces of the pipe body 1 is increased, thereby increasing the heat transfer quantity, but the heat exchanger core of the type illustrated in FIG. 1, a fluid which flows through the pipe body 1 impinges against the fins 4A and 4B, resulting in vortex flows so that there arises the problem that compared with the increase of the heat transfer coefficient, the pressure loss is increased a little. In the case of the heat exchanger core of the type illustrated in FIG. 2, a plurality of fluid streams only flow straightly along the fins 4A and 4B in the pipe body 1 so that there arises the problem that heat transfer will not so increased even though the heat transfer surfaces are increased because the heat transfer coefficient is decreased.

Japanese Laid-Open Patent No. 113998/1981 or No. 117097/1981 discloses another type of a heat exchanger core in which a plurality of spiral grooves are defined in parallel with each other over the inner surface of a cylindrical pipe body.

However, in the case of the heat exchanger core of the type described above, due to a plurality of parallel spiral grooves within the pipe body, many vortex flows are formed within the pipe body so that there arises the problems that the pressure loss becomes higher and that the heat transfer coefficient is increased.

Furthermore as a heat exchanger core used in the above-mentioned electronic equipment, well known in the art is the so-called heat sink which dissipates heat from the heat generation component parts such as transistors, diodes, thyristor and the like which are mounted on an electronic device.

FIG. 3 illustrates a conventional heat exchanger core of the type just described above. Electronic component parts which generate heat such as transistors, diodes, thyristors and the like 7 are threadably mounted on the upper surface of a metal base 6 of a core by means of screws 8, whereby a heat exchanger is constructed. A plurality of parallel elongated grooves 9 are formed in the undersurface of the base plate 6 and are spaced apart from each other by a suitable distance so that the upper side edges of rectangular fins 10 are snugly fitted into the elongated grooves 9.

In the case of the heat exchanger of the type illustrated in FIG. 3, a plurality of air streams flow through the spaces defined by the adjacent fins 10 so that heat generated by the heat generating component parts 7 and transferred by conduction from the base plate 6 to the fins 10 is dissipated into the surrounding air.

However in that case, the air which flows between the adjacent fins 10 will not be vortex flow, but will be laminar so that there arises the problem that the heat transfer coefficient is low and therefore the heat transfer quantity by convection is not increased even though heat transfer surfaces are increased.

SUMMARY OF THE INVENTION

In view of the above, the primary object of the present invention is to provide a heat exchanger core which can substantially solve the above and other problems encountered in the conventional heat exchanger cores; in which a fluid is caused to flow in the direction inclined at a predetermined angle with respect to the axis of a pipe body so that the fluid is uniformly mixed within the pipe body, the rate of the increase in pressure loss is kept small as compared with the increase in the thermal conductivity; and which facilitates the effect of the heat transfer by convection, whereby the thermal exchanger core can have a high degree of performance and can be made compact in size and light in weight and highly reliable and dependable in operation.

The above described object can be obtained by a heat exchanger core of the type in which the heat transfer is effected between a fluid flowing through a pipe body rectangular in cross section, a plurality of substantially parallel fins are extended from the opposing inner wall surfaces and/or a plurality of substantially parallel elongated grooves are formed in the opposing inner wall surfaces in the direction inclined at a predetermined angle with respect to the direction in which the fluid flows but in the same direction on the inner wall surfaces.

BRIEF DESCRIPTION OF THE ACCOMPANYING DRAWINGS

DETAILED DESCRIPTION OF THE PREFERRED EMBODIMENT

Figure 2:
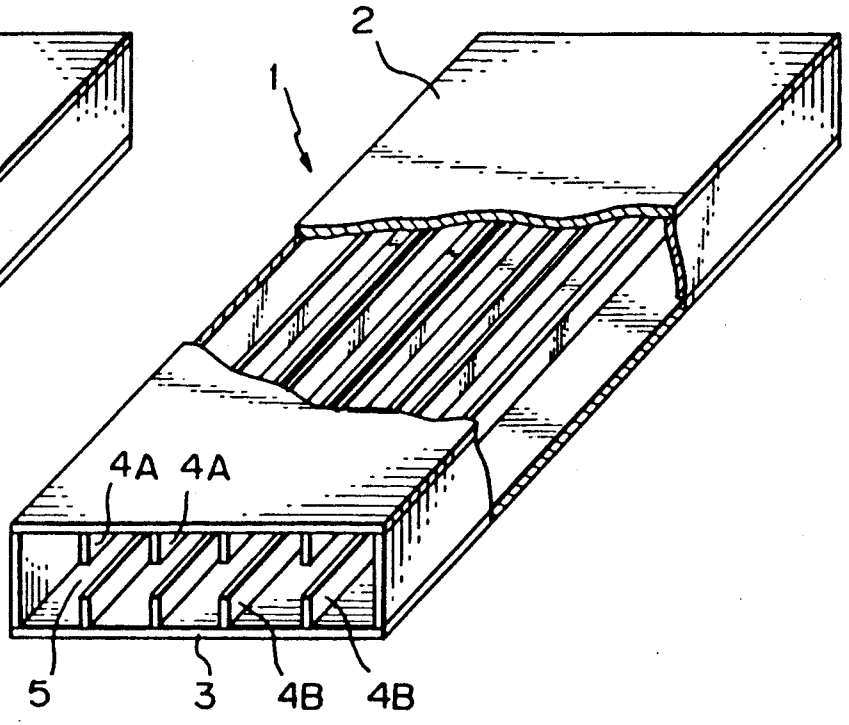
Fig. 2 ( PRIOR ART )
FIGS. 1, 2 and 3 are perspective view of three conventional heat exchanger cores, respectively.
Figure 1:
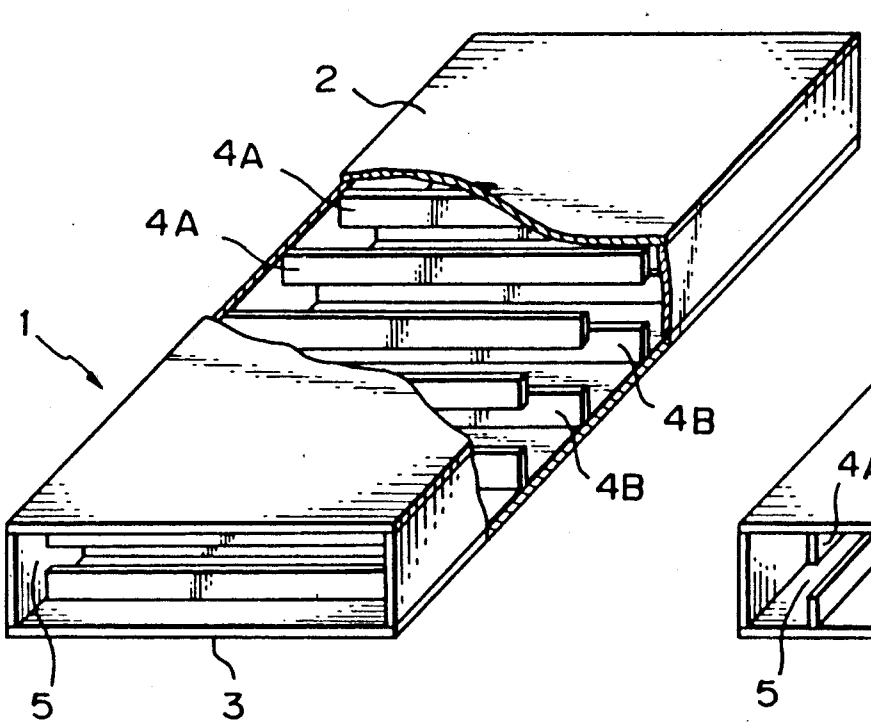
Fig. 1 ( PRIOR ART )
Figure 3:
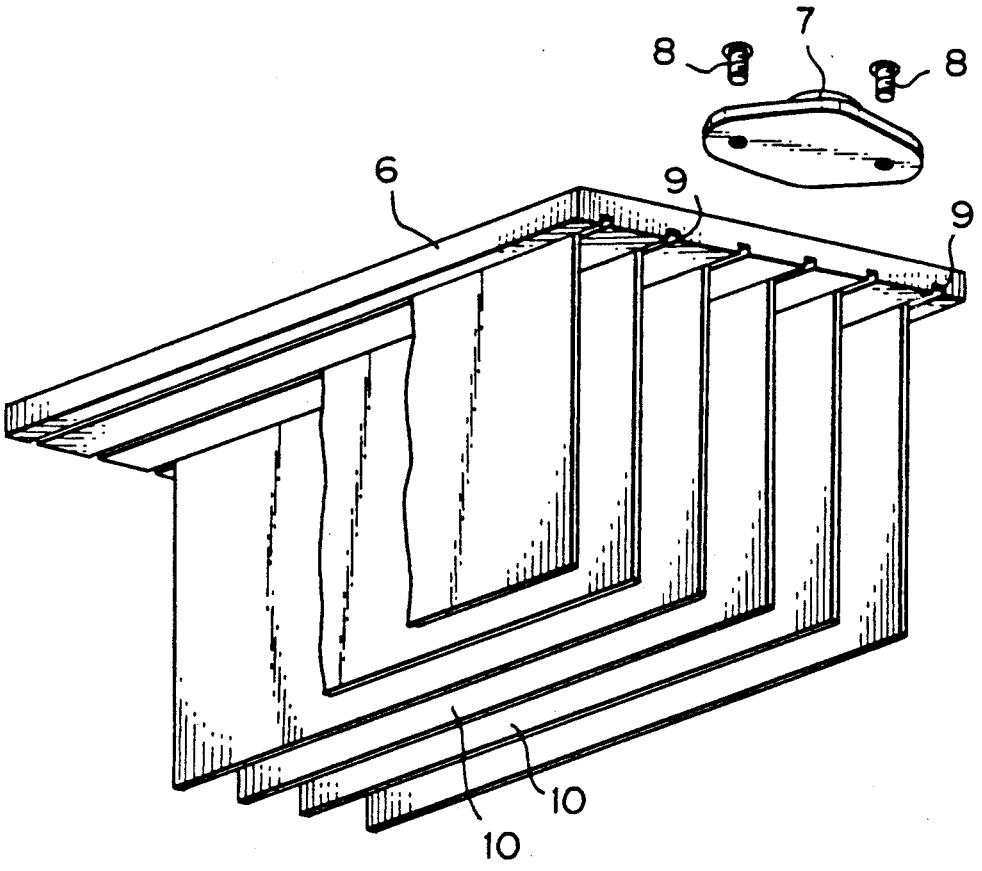
Fig. 3 ( PRIOR ART )
Figure 4:
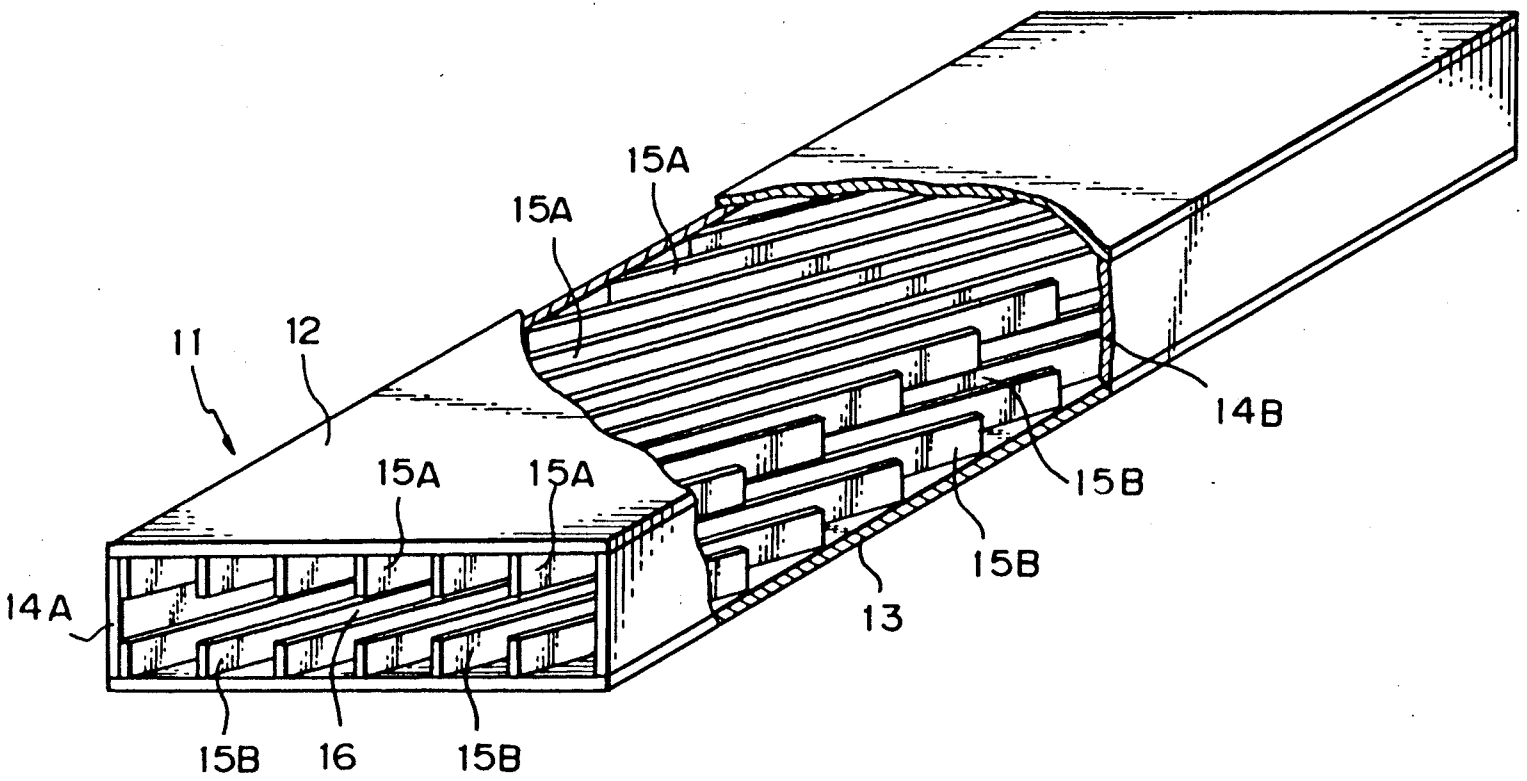
FIG. 4 is a perspective view, partly cut away, of a first preferred embodiment of a heat exchanger core in accordance with the present invention.
Figure 5:
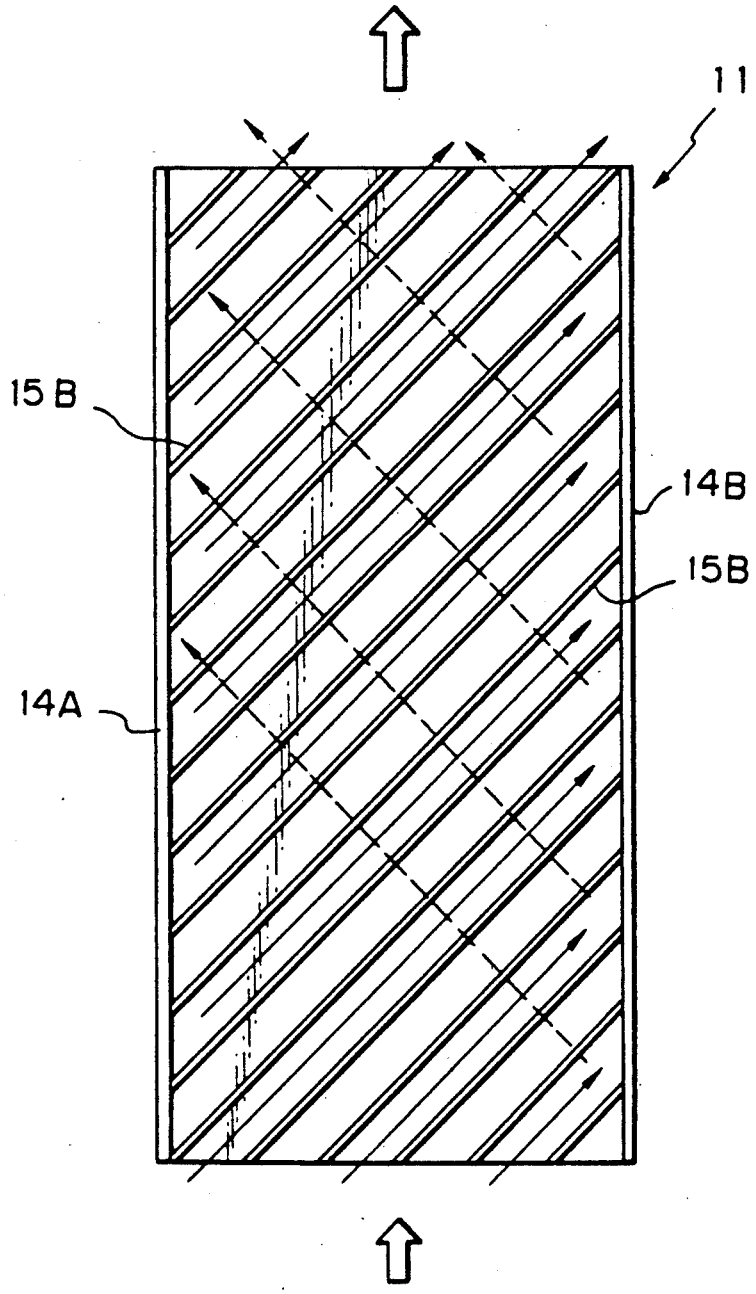
FIG. 5 is a view used to explain the mode of operation of the first preferred embodiment shown in FIG. 4.

First Embodiment, FIGS. 4 and 5

FIGS. 4 and 5 illustrate a first preferred embodiment of a heat exchanger core in accordance with the present invention of the type in which the heat exchange is carried out between a fluid flowing through a pipe body and a fluid flowing outside thereof.

As best shown in FIG. 4, the pipe body 11 has a rectangular cross sectional view and is made of a metal with a high degree of thermal conductivity such as an aluminum alloy, copper, brass or the like. Upper and lower walls 12 and 13 both with a relatively great width and right and left side walls 14A and 14B with a width shorter than the width of the upper and lower walls 12 and 13 are assembled by brazing into the pipe body rectangular in cross section.

A plurality of parallel fins 15A extend from the inner surface of the upper wall 12 and in like manner a plurality of parallel fins 15B extend from the inner surface of the lower wall 13 which is in opposition relationship with the upper wall 12. The fins 15A and 15B are in the form of a flat plate or sheet and are made of a metal with a high degree of thermal conductivity such as an aluminum alloy, copper, brass or the like. The fins 15A and 15B extend in parallel with each other from the inner surfaces of the upper and lower walls 12 and 13, but they are inclined at an angle with respect to the axis of the pipe body 11 in the same direction. The distance between the adjacent fins 14A extending from the inner surface of the upper wall 12 is equal to that between the adjacent fins 14B extended from the inner surface of the lower wall 13 and the fins 14A and 14B are in opposing relationship in the vertical direction. The vertical distance 16 of a gap defined between each opposing upper and lower fins 15A and 15B is substantially equal to the height of the upper and lower fins 15A and 15B. It is preferable that the ratio of the vertical distance of the gap 16 to the height of the fins 15A and 15B be about 0.5–4.0.

In order to securely join the fins 15A and 15B to the inner surfaces of the upper and lower walls 12 and 13, a soldering process or an adhesive agent may be used, but both the upper and lower walls 12 and 13 art subjected to a roller forming process so that the fins 15A and 15B are defined integral with the upper and lower walls 12 and 13, respectively. Thereafter, the upper and lower walls 12 and 13 are cut off into a rectangular shape in such a way that the fins 15A and 15B extending from the inner surfaces of the upper and lower walls 12 and 13 are inclined at a predetermined angle with respect to the lengthwise axes of the upper and lower walls 12 and 13. In addition after the inner surfaces of the upper and lower walls 12 and 13 are coated by brazing, the fins 15A and 15B may be joined to them by braze welding.

It is preferable that the angle of inclination of the fins 5A and 15B with respect to the longitudinal axes, namely, the direction in which the fluid flows be 20–60°.

With the heat exchanger core with the above-described construction, the fluid flowing through the pipe body 11 contacts many fins 15A and 15B so that the heat transfer surface is increased. When the fluid is caused to flow through the passages defined by the adjacent fins 15A extending downwardly from the inner surface of the upper wall 12 and by the adjacent fins 15B extending upwardly from the inner surface of the lower wall 13 as indicated by the bold-line arrows in FIG. 5, the fluid strikes at one of the side walls 14B so that it is redirected toward the gaps between the vertically opposing fins 15A and 15B. Then as indicated by the broken-line arrows in FIG. 5, the fluid is redirected in the line symmetrical direction with respect to the direction in which the fins 15A and 15B are extended, with the direction indicated by the bold-line arrows being the axis of symmetry and flows through the gaps 16 at an angle inclined with respect thereto. Next the fluid impinges on the other side wall 14 and is divided into the upper and lower streams. Thereafter the fluid is redirected into the passages defined by the adjacent fins 15A and 15B and flows again in the direction inclined at a predetermined angle with respect to the longitudinal axis of the pipe body 11.

As described above, the fluid always flows through the passages defined by the adjacent fins 15A and 15B and through the gaps between the vertically opposing fins 15A and 15B alternately.

As described above, according to the first preferred embodiment of the present invention, the fluid flows through the passages defined by the adjacent upper fins 15A and by the adjacent lower fins 15B along the fins 15A and 15B in the direction inclined at a predetermined angle with respect to the axis of the pipe body 11 so that the relative speed becomes fast and the heat transfer coefficient is increased. Furthermore when the fluid impinges on the side walls 14A and 14B, it is redirected so that the streams of the fluid are uniformly mixed and the local temperature distribution or difference will not occur. As a result, as compared with the increase in pressure loss, the efficiency of the heat transfer by convection is increased further, thereby increasing the efficiency of heat exchange rate or volume. Therefore the first preferred embodiment of the present invention can exhibit a high degree of performance and can be made compact in size and light in weight and highly reliable and dependable in operation.

So far it has been described that the fins 15A extending downwardly from the inner surface of the upper wall 12 are in opposing relationship in the vertical direction, but it is to be understood that the gap defined between the adjacent upper fins 15A can be made different from the gap defined between the adjacent. lower fins 15B; that is, it is not needed to design and construct the upper and lower fins 15A and 15B such that they are in vertically opposing relationship with each other. Furthermore it is also possible to vary the gaps defined between the adjacent upper and lower fins 15A and 15B. That is, the distances of the gaps defined by the adjacent upper fins 15A as well as the distances of the gaps defined by the adjacent lower fins 15B may be selected at random.

It should be noted here that even when the gaps between the adjacent upper fins 15A and the gaps defined by the adjacent lower fins 15B are increased or decreased, the heat transfer coefficient per unit area is less influenced.

Figure 6:
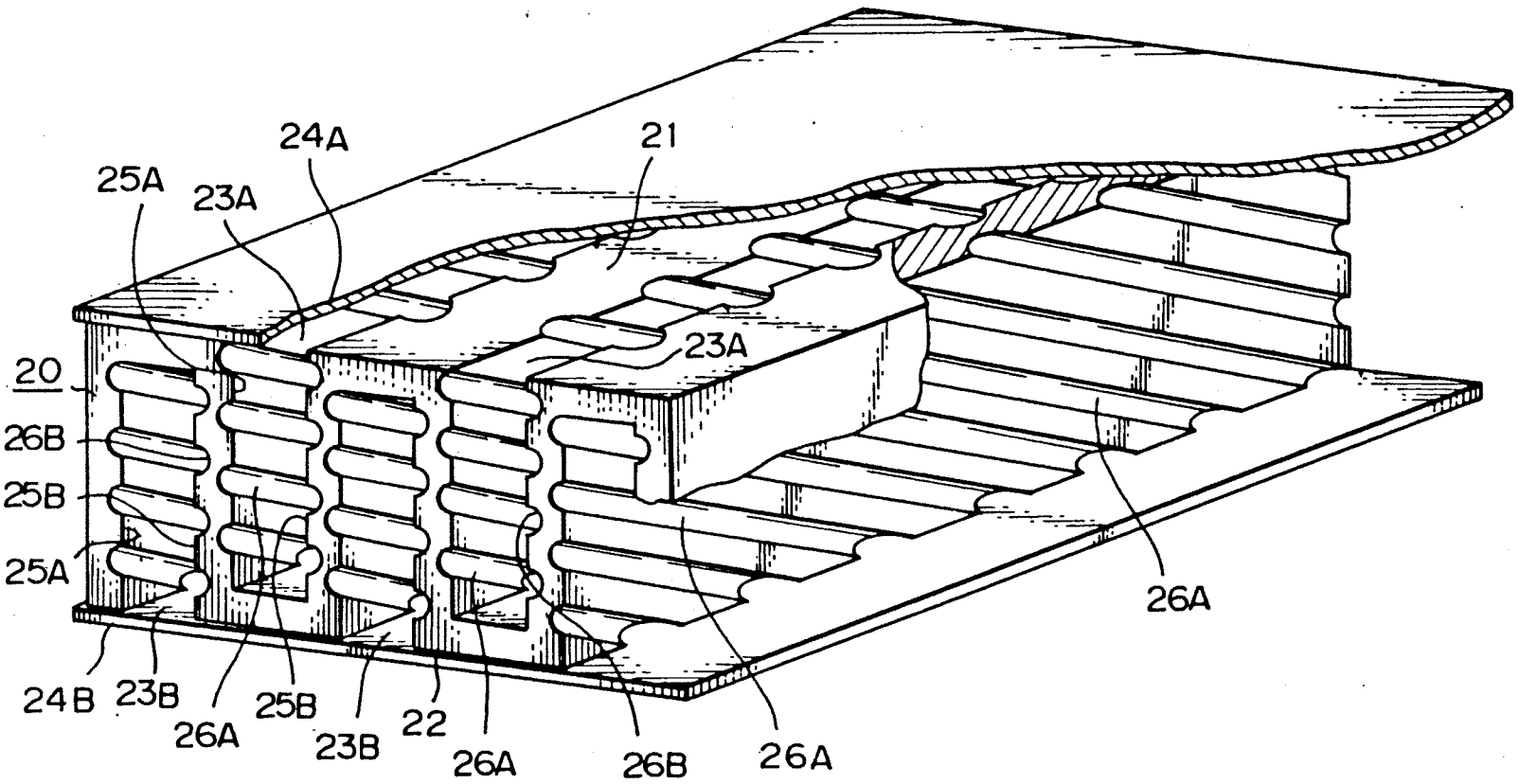
FIG. 6 is a perspective view, partly broken, of a second preferred embodiment of a heat exchanger core in accordance with the present invention.
Figure 7:
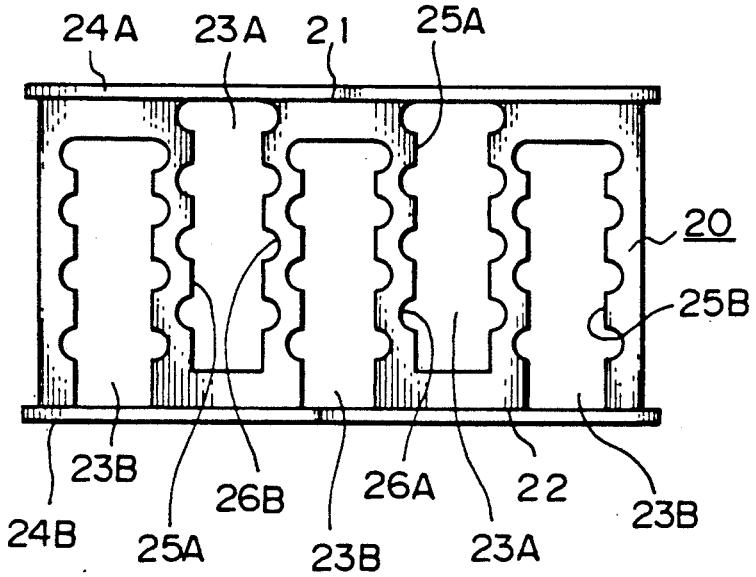
FIG. 7 is an end view of FIG. 6.
Figure 8:
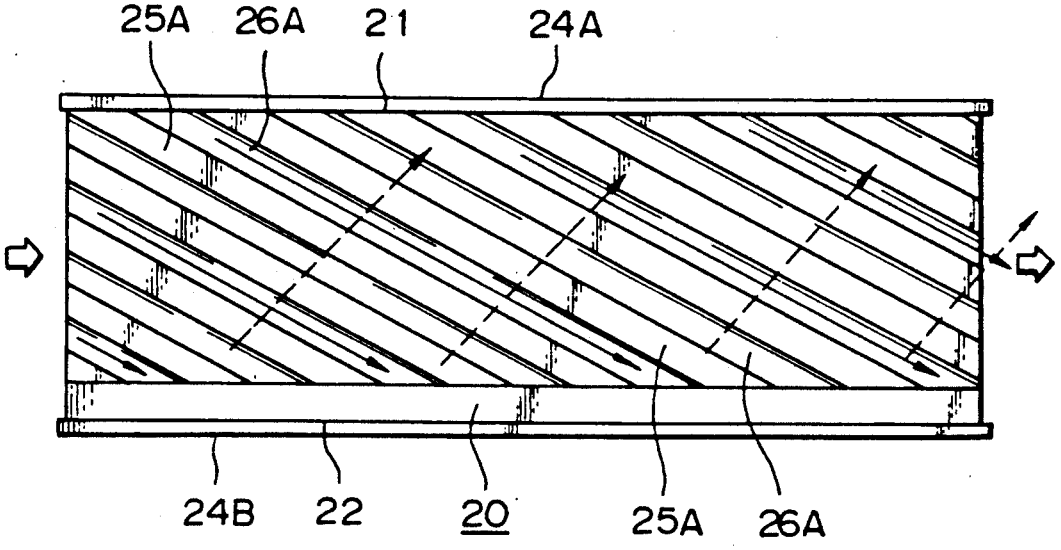
FIG. 8 is a view uses to explain the mode of operation of the second preferred embodiment shown in FIGS. 6 and 7.

Second Embodiment, FIGS. 6–8

Referring next to FIGS. 6-8, a second preferred embodiment of the present invention adapted for use in a large-sized heat exchanger will be described. The second embodiment has a block-shaped housing 20 rectangular in cross section made of a metal or alloy having a high degree of thermal conductivity such as aluminium alloy, copper, brass or the like. Within the housing 20, a plurality of flow passages 23A connected to an upper surface 21 and a plurality of flow passages 23B connected to a lower surface 22 are alternately disposed in parallel with each other.

Both ends of the flow passages 23A and 23B are opened so as to permit flow of a fluid in the horizontal direction. The upper opened end of each flow passages 23A is closed by a cover 24A which in turn is securely attached to the upper surface 21 while the lower open end of each flow passages 23B is closed by a cover 24B which in turn is securely attached to the lower surface 22.

The opposing surfaces 25A and 25B of the adjacent flow passages 23A and 23B are formed with a plurality of elongated grooves 26A and 26B which have an arcuated cross sectional configuration and which are in parallel with each other. Each of the elongated grooves 26A defined at one inner surface 25A and each of the elongated grooves 26B defined at the other inner surface 25B are inclined at a same predetermined angle with respect to the horizontal direction in which the fluid flows so that the lower part of each grooves 26A, 26B with respect to the direction in which the fluid flows is directed downward, but are arrayed in the parallel direction on the inner surfaces 25A and 25B. Moreover the lower part of each grooves 26A, 26B may be directed upward. Furthermore the distance of the gap defined between the adjacent elongated grooves 26A at the inner surface 25A is equal to that of the gap between the adjacent elongated grooves 26B and the elongated grooves 26A and the elongated grooves 26B are in opposing relationship with each other in the horizontal direction. It is preferable that the angle of inclination of the elongated grooves 26A and 26B be 20–60° with respect to the direction in which the fluid flows.

In order to construct the housing 20, metal-sheet blanks may be formed with the elongated grooves 26A and 26B by a press or embossing apparatus and then bent. Alternatively, by casting or an extruding machine, a plurality of metal-sheet blanks are formed with the elongated grooves 26A and 26B and the metal sheets thus processed may be spaced apart from each other by a suitable distance and joined by an adhesive or braze welding.

With the heat exchange core according to the second preferred embodiment of the present invention, a fluid to be subjected to the heat exchange process is caused to flow through the elongated passages 23A or 23B while a fluid which receives heat from the fluid flowing through the passages 23A is made to flow through the passages 23B or 24B, whereby the heat exchange is carried out between the two fluids. When the fluid is caused to flow in the direction indicated by the bold-line arrow as shown in FIG. 8, part of the fluid flows through the elongated grooves 26A and 26B as indicated by the solid-line arrows so that the heat transfer surface is increased in area. Furthermore, the fluids are caused to flow in the direction inclined at a predetermined angle with respect to the direction of the elongated grooves 26A and 26B through which the fluids flows. Thereafter within the flow passages 23A and 23B, the fluids impinge on the housing or the cover 24B and are redirected in the directions of the centerlines between the width of the flow passages 23A and 23B. As a result, the fluid is redirected in the direction which is line symmetrical with respect the direction in which the elongated grooves 26A and 26B are extended, with the direction indicated by the bold-like arrow being the axis of symmetry so that the fluid is caused to flow in the direction inclined at a predetermined angle with respect to the flow passages 23A or 23B. Next the fluid impinges on the housing or the other cover 24A and is divided into the right and left streams Thereafter the fluid is redirected into the elongated grooves 26A or 26B to flow in the direction inclined.

The streams of the fluid are mixed and are made into contact with the whole wall surfaces of the flow passages 23A and 23B in the manner described above.

According to the second preferred embodiment, as described above, the fluids are caused to flow in the inclined direction in line symmetry relationship within the flow passages 23A and 23B, respectively, except the elongated grooves 26A and 26B and through the elongated grooves 26A and 26B in the flow passages 23A and 23B. As a result, the relative speed of the fluid becomes faster and the heat transfer coefficient is considerably increased as compared with the increase of the pressure loss. The fluids are mixed in the flow passages 23A and 23B so that the fluid temperatures can be maintained uniformly so that the efficiency of heat transfer can be remarkably improved.

Figure 9:
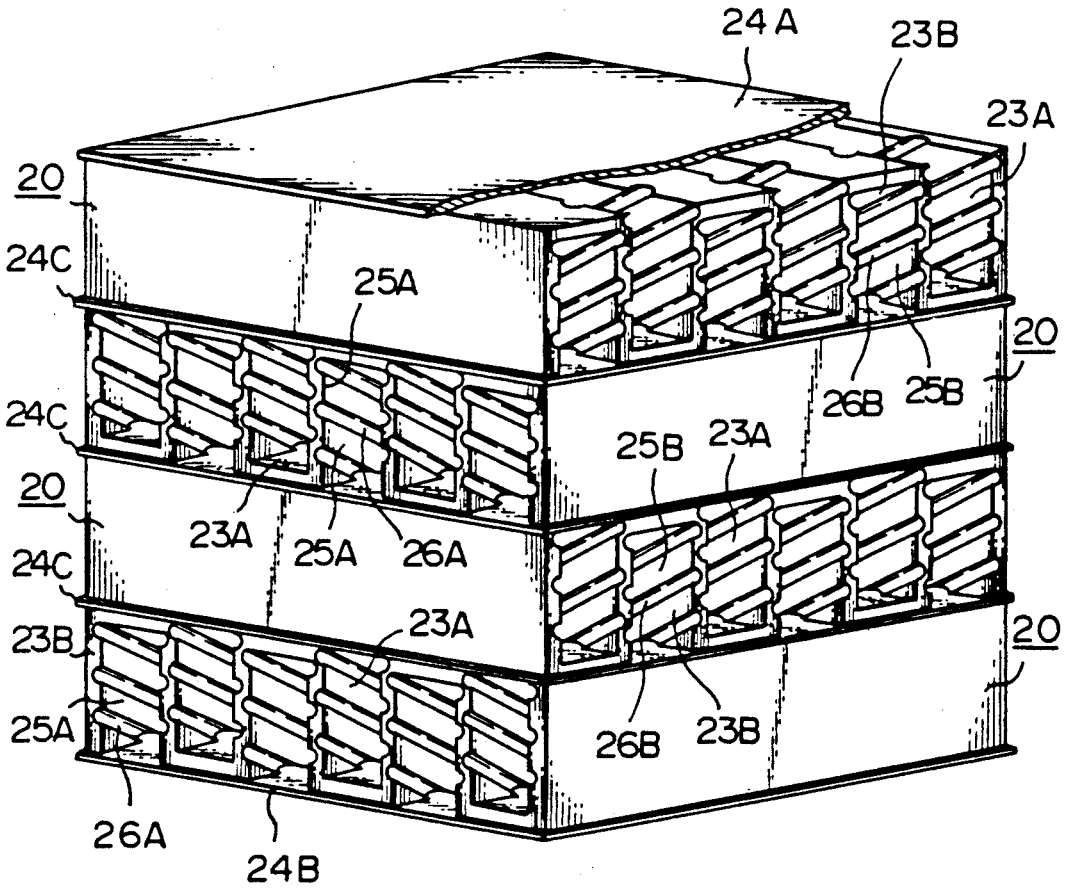
FIG. 9 is a perspective view, partly cut out, of a modification of the second preferred embodiment shown in FIGS. 6 and 7.

Modification, FIG. 9

FIG. 9 illustrates a modification of the second preferred embodiment. According to this modification, a plurality of heat exchanger cores described above with reference to FIGS. 6–8 are laminated in such a manner that the flow passages 23A and 23B in the adjacent cores become perpendicular to each other. A heat radiating fluid or a heat receiving fluid is caused to flow through the flow passages 23A and 23B extending in one direction while a heat receiving fluid or a heat radiating fluid is caused to flow through the passages 23A and 23B extending in the other direction. The upper surface of the uppermost housing 20 is covered by a cover plate 24A while the undersurface of the lowermost housing 20 is covered with a cover plate 24B and a cover plate 24C is interposed between the adjacent housings 20 between the uppermost and lowermost housings 20.

With the modification with the above-described construction, heat transfer can be carried out at a high degree of efficiency.

According to this modification, in addition to the elongated grooves 26A and 26B in each of the flow passages 23A and 23B, projections are interposed between the adjacent elongated grooves 26A and 26B so that each flow passage may have a waveform cross sectional configuration. From the standpoint of fabrication, a flow passage having a waveform cross sectional configuration is superior to a flow passage formed with a plurality of elongated grooves. In order to alternately form a plurality of grooves and a plurality of projections, there can be used a method in which a metal-sheet blank is formed into a plate having a waveform cross sectional configuration by pressing and the plate thus obtained is folded.

Figure 10:
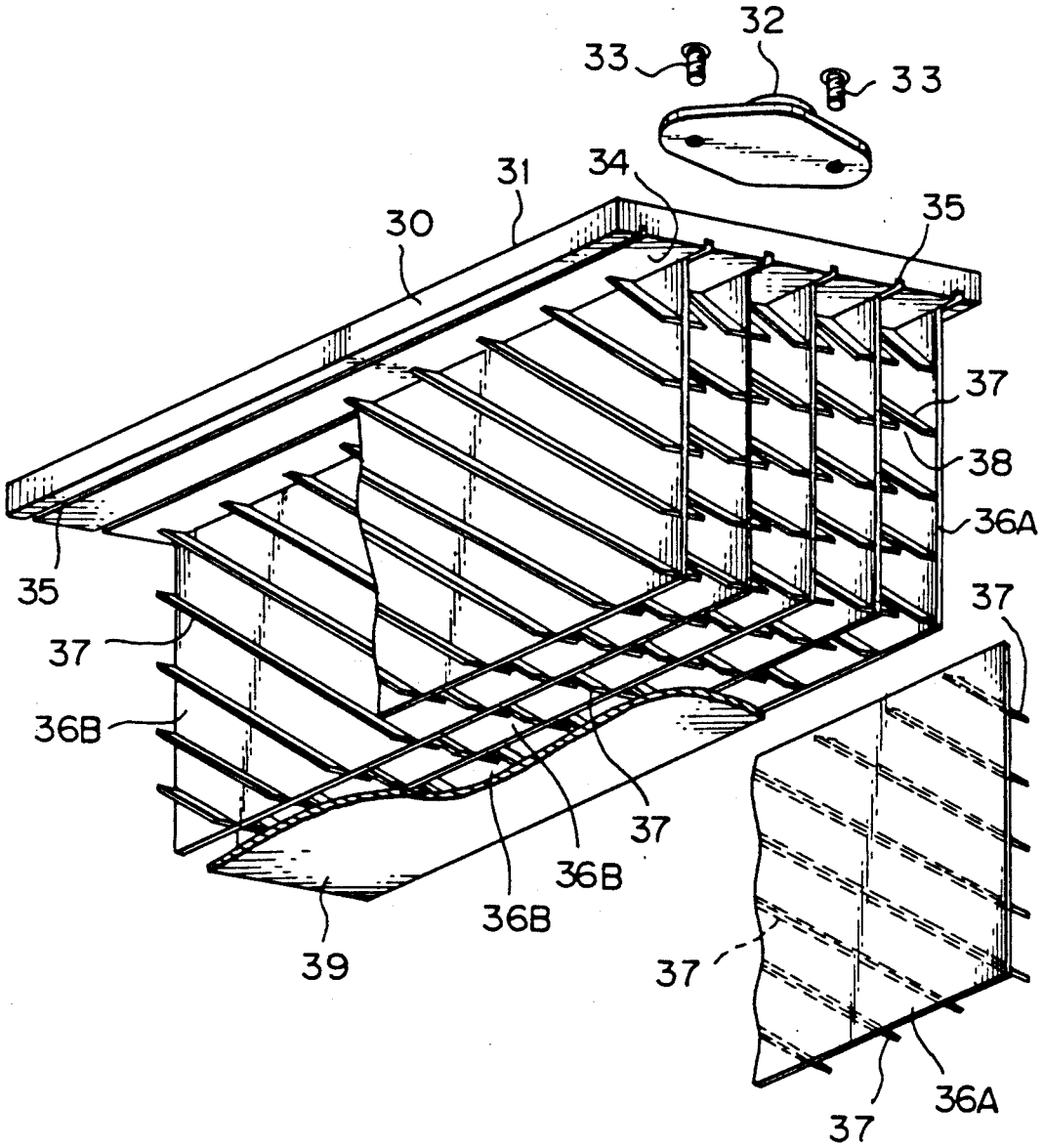
FIG. 10 is an exploded perspective view, partly cut away, of a third preferred embodiment of a heat exchanger core in accordance with the present invention.
Figure 11:
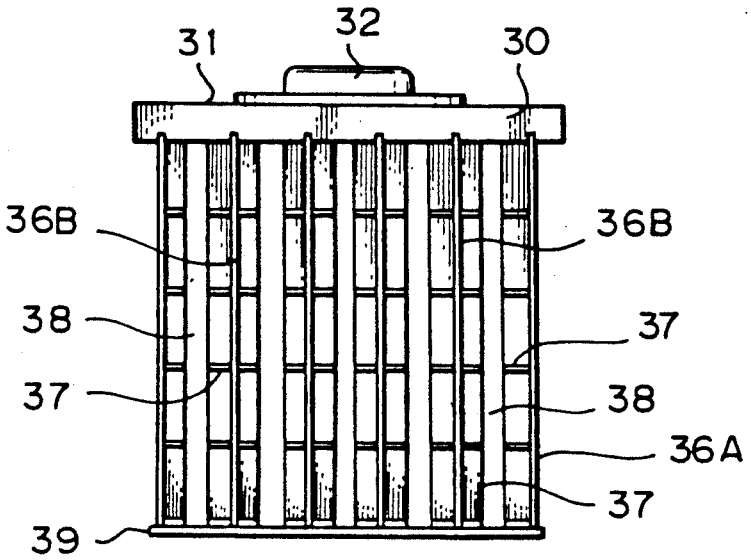
FIG. 11 is an end view of the third preferred embodiment when assembled.
Figure 12:
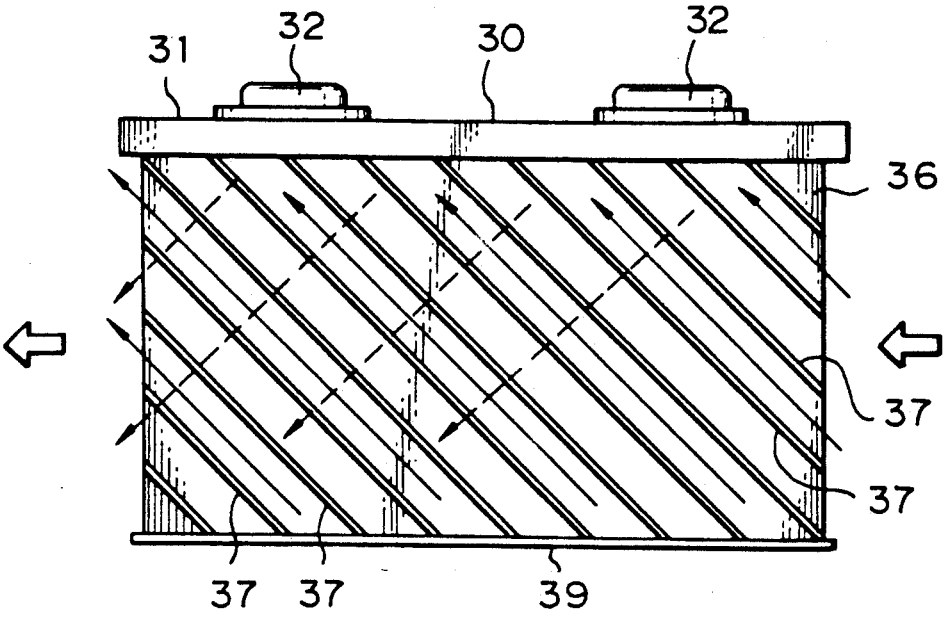
FIG. 12 is a view used to explain the mode of operation of the third preferred embodiment shown in FIGS. 10 and 11.

Third Embodiment, FIGS. 10–12

FIGS. 10–12 illustrate a third preferred embodiment of a heat exchange core in accordance with the present invention especially adapted to dissipate heat from heat source component parts such as transistors, diodes, thyristors and the like used in electronic devices.

As shown in FIGS. 10–11, the third embodiment has a rectangular base plate 30 made of an aluminum alloy, copper, brass or the like having a high thermal conductivity. The base plate 30 is greater in thickness and two heat-generating component parts 32 are mounted on the upper surface of the base plate and securely held in position by two screws 33, respectively. The undersurface 34 of the base plate 30 is formed with a plurality of elongated grooves 35 extending from one side to the other side and are spaced apart from each other by a suitable distance in parallel with each other. The upper ends of rectangular sheet-shaped fins 36A and 36B are fitted into the elongated grooves 35 and securely joined thereto by suitable joining means such as welding, braze welding or the like in such a way that the fins 36A and 36B depend from the undersurface 34 in parallel with each other. The sheet-like fins 36A and 36B are also made of a metal having a high heat conductivity as in the case of the base plate 30.

Of a plurality of sheet-like fins 36A and 36B, each of those except the outermost fins 36A has a plurality of auxiliary fins 37 extending from the major surfaces thereof in parallel with each other and in opposed relationship with the auxiliary fins 37 extending from the opposing surfaces of the adjacent sheet-like fins 36B. These auxiliary fins 37 are in the form of a flat sheet made of a metal having a high heat conductivity such as an alumina alloy, copper, brass or the like and are inclined at a predetermined angle with respect to the axis of the heat exchanger core in the same direction. The auxiliary fins 37 of each sheet-like fin 36B are spaced apart from each other by a suitable distance and the auxiliary fins 37 extending from the major surfaces of the adjacent sheet-like fins 36B are in opposing relationship with each other and are spaced apart from each other by a suitable distance to define gaps 38 therebetween. The auxiliary fins 37 only extend from the inner major surfaces of the outermost sheet-like fins 36A in a manner substantially similar to that described above. The auxiliary fins 37 are securely joined to the sheet-like fins 36A and 36B by, for example, braze welding. The sheet-like fins 36A and 36B are just represented by the numeral "36" hereinafter in this specification.

If necessary, a cover plate 39 is securely joined to the lower ends of the sheet-like fins 36. Such cover plate 39 is not needed in some cases and may be partially cut out.

Next the mode of the operation of the third preferred embodiment with the above-described construction will be described.

A fluid such as air or the like is caused to flow through the passages defined by the adjacent sheet-like fins 36 as indicated by the bold-line arrow in FIG. 12 so that heat generated by the heat radiating component parts 32 is transmitted to the base plate 30 and then to the sheet-like fins 36 and is dissipated into the flowing air or the like. In this case the fluid such as air or the like is forced into contact with the sheet-like fins 36 and the auxiliary fins 37 so that the heat transmission surfaces are increased. As indicated by the solid-line arrow in FIG. 12, the streams of the fluid such as air or the like flow through the gaps between the adjacent fins 37 and impinge on the base plate 30 so as to be redirected into the gaps 38. As a result, the fluid streams are redirected in the direction which is in line symmetry with the direction in which the auxiliary fins 37 are extended with the direction indicated by the bold-like arrow being the axis of symmetry so that the fluid streams flow through the gaps 38 in the inclined direction as indicated by the broken-line arrows shown in FIG. 12. In the third embodiment, the fluid streams impinge on the cover plate 39 and are redirected in the passages between the adjacent auxiliary fins 37 to flow therethrough again in the inclined direction.

As described above, the fluid streams flow alternately through the spaces defined between the adjacent auxiliary fins 37 and the gaps 38 so that the fluid streams are completely forced into contact with the sheet-like fins 36 and the auxiliary fins 37 so that the temperature of the fluid streams becomes uniform.

As described above, according to the third preferred embodiment, the fluid streams are forced into contact with a plurality of sheet-like fins 36 and a plurality of auxiliary fins 37. Furthermore the heat transfer coefficient is increased so that the efficiency of heat dissipation capability is remarkably increased. In general, with the increase in effective surface area, the pressure drop is extremely increased, but according to the third embodiment, the fluid streams flow between the auxiliary fins 37 and the gaps 38 in the inclined directions so that the relative speed of the fluid is increased and the heat transfer coefficient is also increased. Therefore in spite of the increase in pressure drop, the third embodiment has various advantages as a radiator for electronic component parts.

In the first, second and third embodiment, it has been described that the fins 15A and 15B, the elongated grooves 26A and 26B and the auxiliary fins 37 are all inclined in the same direction, but it is not needed to incline them at an angle with a high degree of accuracy. The angle of inclination is not limited to that shown in the figures and what is essential is the flow of a fluid is so inclined that the flow conditions vary. The appended claims are, therefore, intended to cover and embrace any such modifications within the limits only of the true spirit and scope of the invention.

What is claimed is:

1. A heat exchanger core of the type in which a fluid is caused to flow through a pipe body rectangular in cross section so that heat exchange between said fluid and a heat medium in contact with said pipe body is carried out, characterized in that a plurality of parallel projections and/or grooves are formed on respective facing inner surfaces of opposing interior walls of said pipe body, said projections and/or grooves being substantially equally inclined at an acute angle with respect to direction of flow of said fluid along said facing interior walls and arranged in the same direction on said opposing inner surfaces of said opposing walls, wherein opposed ones of said facing projections and/or grooves are aligned and parallel one with another along the length of said pipe body through which fluid flows; wherein said facing projections and/or grooves extend along said respective facing inner surfaces of said opposing interior walls, between respective facing planar walls of said pipe body which are perpendicular to said walls on which said projections and/or grooves are formed; said facing projections and/or grooves contacting said respective planar walls at respective longitudinal extremities of said projections and/or grooves.

2. The heat exchange core of claim 1 wherein said angle is between about 20 and about 60 degrees respecting direction of heat transfer fluid flow through said pipe body.

3. The heat exchange core of claim 2 wherein ratio of distance separating opposed facing ones of said projections to distance said projections extend from said facing surfaces is between about 0.5 and about 4.0.

4. The heat exchange core of claim 1 wherein said grooves have smooth curved surfaces.

5. The heat exchange core of claim 4 wherein said grooves have semi-circular surfaces.

6. The heat exchange core of claim 5 wherein said grooves are straight.

7. The heat exchange core of claim 4 wherein said grooves are straight.

8. A heat exchanger core in which fluid flows through said core so that heat exchange between said fluid and a heat medium in contact with an exterior surface of said core is carried out, comprising:

a. a plurality of sheet-like fins extending into an interior conduit formed in said core, said fins being mounted on an interior surface of a portion of said core on which said exterior surface contacting said heat medium is formed, said fins being substantially transverse to said interior surface and substantially parallel with direction of heat transfer fluid flow through said conduit; said fins extending transversely across said conduit between and contacting mutually facing interior conduit walls which are substantially transverse to said surface on which said fins are mounted;

b. a plurality of parallel projections and/or grooves formed on said plurality of sheet-like fins extending from inner surfaces of opposing walls of said core, said projections and/or grooves being substantially equally inclined at an acute angle with respect to the direction of the flow of said fluid and arranged in the same direction on said opposing inner surfaces of said opposing walls;

c. respective longitudinal extremities of said parallel projections and/or grooves contacting said mutually facing interior conduit walls which are substantially transverse to said walls from which said fins extend.

9. The heat exchange core of claim 8 wherein said angle is between about 20 and about 60 degrees respecting direction of heat transfer fluid flow through said pipe body.

10. The heat exchange core of claim 9 wherein said conduit is substantially of rectangular cross-section.

11. The heat exchange core of claim 10 wherein said projections are substantially perpendicular to said fins.

12. The heat exchange core of claim 9 wherein ratio of distance separating opposed facing ones of said projections to distance said projections extend from said facing surfaces is between about 0.5 and about 4.0.

13. The heat exchange core of claim 12 wherein said grooves have smooth curved surfaces.

14. The heat exchange core of claim 13 wherein said grooves have semi-circular surfaces.

15. The heat exchange core of claim 14 wherein said grooves are straight.

16. The heat exchange core of claim 13 wherein said grooves are straight.

17. A heat exchange core of the type in which a fluid is caused to flow through a rectangular cross section pipe body so that heat exchange occurring between said fluid and a heat medium in contact with said pipe body, comprising:

a. a plurality of parallel projections and/or grooves formed on respective facing inner surfaces of opposing interior walls of said pipe body;

b. said projections and/or grooves being substantially equally inclined at an acute angle with respect to direction of fluid flow into said pipe body;

c. opposing corresponding ones of said facing projections and/or grooves being aligned and parallel one with another along the length of said pipe body through which fluid flows;

d. said facing projections and/or grooves extending along said respective facing inner surfaces of said opposing interior walls, between respective facing planar walls of said pipe body which are perpendicular to said walls on which said projections and/or grooves are formed;

e. said facing projections and/or grooves contacting said respective facing planar walls which are perpendicular to said walls on which said projections or grooves are formed, along lines which are perpendicular to said planar walls of said pipe body on which said projections and/or grooves are formed and perpendicular to said direction of fluid flow into said pipe body, at respective longitudinal extremities of said projections and/or grooves.

18. A heat exchanger core in which fluid flows through said core so that heat exchange between said fluid and a heat medium in contact with an exterior surface of said core is carried out, comprising:

a. a plurality of sheet-like fins extending into an interior conduit formed in said core;

1. said fins being mounted on an interior surface of a portion of said core on which said exterior surface contacting said heat medium is formed;
2. said fins being substantially transverse to said interior surface and substantially parallel with direction of heat transfer fluid flow through said conduit;
3. said fins extending transversely across said conduit between and contacting mutually facing interior conduit walls which are substantially parallel to and facing said surface on which said fins are mounted;

b. a plurality of parallel projections and/or grooves formed on said plurality of sheet-like fins extending from inner surfaces of opposing walls of said core, 1. said projections and/or grooves being substantially equally inclined at an acute angle with respect to the direction of the flow of said fluid into said core and
2. arranged in a common angular direction respecting the direction of fluid flow into said core on said opposing inner surfaces of said opposing walls;

c. respective longitudinal extremities of said parallel projections and/or grooves contacting said mutually facing interior conduit walls along straight lines which are substantially transverse to said fins and to said direction of fluid flow into said core.

* * * * *